US006462477B1

(12) United States Patent
Wada et al.

(10) Patent No.: US 6,462,477 B1
(45) Date of Patent: Oct. 8, 2002

(54) HIGH PRESSURE DISCHARGE LAMP

(75) Inventors: Masato Wada, Hyogo; Akio Takubo, Osaka; Akira Mii, Hyogo, all of (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/888,706

(22) Filed: Jun. 25, 2001

(30) Foreign Application Priority Data

Jun. 30, 2000 (JP) ..... 2000-198323
Feb. 28, 2001 (JP) ..... 2001-054009

(51) Int. Cl.[7] ..... H01J 7/44
(52) U.S. Cl. ..... 315/73; 315/58
(58) Field of Search ..... 315/46, 58, 59, 315/73, 240, 241 R, 243, 289, 290, 309, 112, 115, 117

(56) References Cited

U.S. PATENT DOCUMENTS 4,473,778 A * 9/1984 Adachi ..... 315/241 R
5,389,856 A * 2/1995 Luijks et al. ..... 315/58
5,420,479 A * 5/1995 Iida et al. ..... 315/73

FOREIGN PATENT DOCUMENTS

| | | |
|---|---|---|
| JP | 5-228956 | 9/1993 |
| JP | 5-290985 | 11/1993 |
| JP | 7-105913 | 4/1995 |
| JP | 9-129186 | 5/1997 |

* cited by examiner

*Primary Examiner*—Don Wong
*Assistant Examiner*—Wilson Lee
(74) *Attorney, Agent, or Firm*—Merchant & Gould P.C.

(57) ABSTRACT

A high pressure discharge lamp is provided with an arc tube and a starter. The starter includes a ferroelectric ceramic capacitor element with non-linear characteristics an a semiconductor switching element, connected in parallel to the arc tube. A pulse stopping thermally-actuated switch is connected in series to the ferroelectric ceramic capacitor element and is operated to OFF by heating of a heating resistor in a non-lighted state of the lamp. Without accompanying reduction of a starting function due to a temperature rise of the ferroelectric ceramic capacitor element, a safety function against a non-lighted state of the lamp is provided.

11 Claims, 7 Drawing Sheets

HIGH PRESSURE DISCHARGE LAMP

FIELD OF THE INVENTION

The present invention relates to a high pressure discharge lamp.

BACKGROUND OF THE INVENTION

High pressure discharge lamps such as a high pressure sodium lamp or a metal halide lamp are widely used for exterior illumination of roads, public squares, sports facilities, etc. or in recent years for exterior illumination of commercial facilities or the like, based on advantageous features that they have a comparatively excellent color rendering property in addition to the merits of high efficiency and high luminance.

In order to light such high pressure discharge lamps, a starter generally is necessary. The starter is classified into two types: an external type incorporated into a lighting ballast and a lamp integrated type incorporated into a lamp itself. The latter lamp integrated type is in widespread use because by combining it with a simple copper iron reactance ballast, the cost of the lamp system is reduced.

Among the conventional built-in starter type high pressure discharge lamps there is one provided with a starter using a ferroelectric ceramic capacitor element with non-linear characteristics. This starter has the merit of high safety in practical use, and the startup performance also is comparatively excellent, so that it is more and more widely spread (See JP5(1992)-87940B, JP5(1992)-290985A).

FIG. 7 shows a conventional example of a built-in starter type high pressure sodium lamp. A starter of this lamp includes a series circuit of a ferroelectric ceramic capacitor (NCC) element 24 connected in parallel to an arc tube 23 of the high pressure sodium lamp and a bilateral semiconductor switching element 25. The starting operation is as follows.

When a power source 13 is applied, the NCC element 24 performs the operation of so-called current switching by cutting off the current based on its non-linear characteristics. Thereby, in a reactance ballast 14, a starting pulse voltage of 1500V to 2000V is induced for every half cycle in superposition on a source voltage, and with this voltage, the arc tube 23 is started. In this operation, the semiconductor switching element 25 serves to raise the starting pulse voltage even more by sharpening the current switching operation by the NCC element 24. In addition, in the configuration shown in FIG. 7, a start assisting conductor 28, which is connected in series to the NCC element 24 and the semiconductor switching element 25 via thermally-actuated switches 26, 27, is provided so as to be attached to the arc tube 23. Through this start assisting effect, the arc tube 23 can be started at a comparatively low starting pulse voltage. After the arc tube 23 has been started, the voltage applied to the NCC element 24 is reduced, and the current switching operation becomes impossible, so that the oscillation of the starting pulse voltage is stopped. Next, due to heat generation of the arc tube 23 after starting, the thermally-actuated switches 26, 27 made of bimetal elements are operated to be in an OFF state, and the steady lighting of the arc tube 23 is maintained in a state in which the starting circuit part including the NCC element 24 and the semiconductor switching element 25 are cut off from the lighting circuit of the arc tube.

According to the lamp configuration as a completed product, the arc tube 23 and all the starter parts excluding the semiconductor switching element 25 are mounted in an evacuated outer tube glass bulb 29. The semiconductor switching element 25 is positioned in a base for reducing its temperature. Therefore, for sealing the outer tube glass bulb, instead of an ordinary glass stem used for sealing two lead wires, a glass stem 17 used for sealing an outer tube glass bulb as shown in FIG. 8A, FIG. 8B is used. FIG. 8A is a plane view thereof, and FIG. 8B is the front view. In the glass stem 17, three lead wires 18, 19, 20 are sealed.

With regard to the lamp integrated with the starter using the NCC element, two problems related to safety were anticipated to arise during its life time. The first problem is that insulation deterioration of a ballast, a distribution cable, a base socket etc. arises in the case where the lamp becomes incapable of lighting and the starting pulse voltage is continued to be applied. It is dangerous for a human body to touch such a lighting device. The second problem is that in the case where a xenon gas for assisting a start, sodium or mercury filled inside the arc tube leaks from the outer tube glass bulb at the end of life and so on, an arc discharge is induced between the lead wires in the outer tube glass bulb due to the starting pulse voltage, and thus, an overcurrent flows due to this arc discharge. In this case, the ballast will be damaged by fire, or in some cases, the outer tube glass bulb will be broken.

In the starter according to the conventional technique shown in FIG. 7, in addition to the basic function of oscillating the starting pulse voltage, the following safety functions are added respectively to solve the two problems mentioned above.

(a) The ferroelectric property showing the non-linear characteristics of the NCC element 24 is maintained in a temperature range of not more than the so-called Curie temperature (normally, about 90° C.). In a temperature range above this, it is changed to the paraelectric property and the non-linear characteristics disappear, and thus, the oscillation of the starting pulse voltage in FIG. 7 is stopped. In order to solve the first problem mentioned above by applying such temperature characteristics of the NCC element 24, a heating resistor 30 connected in parallel to the NCC element 24 and the semiconductor switching element 25 is positioned adjacent to the NCC element 24. Accordingly, even in the case where the arc tube 23 fails to light in spite of the oscillation of the starting pulse voltage, the temperature of the NCC element 24 rises quickly to the Curie temperature or higher by absorbing the heat from the heating resistor 30 in addition to the self heating of the NCC element 24 due to its operation, so that the oscillation of the starting pulse voltage is stopped in a relatively short time.

(b) To solve the second problem mentioned above, first of all, the NCC element 24 itself is designed and constructed to have the so-called self-destructive function. That is, when the starting pulse voltage is applied at the time when a xenon gas etc. leaks, a discharge breakdown occurs due to a creeping discharge between both electrode terminals and so forth, so that the NCC element 24 will be in a conducting state. In addition, a filament coil 31 is connected in series to the NCC element 24. The filament coil 31 has the so-called fuse function, that is, the filament coil 31 is fused by the flow of an excess current caused by the self-destruction and the conduction of the NCC element 24. In this way, by combining the self-destructive function of the NCC element 24 and the fuse function of the filament coil 31, the starter including the NCC element 24 is separated from the lighting circuit and becomes inoperative, so that the starting pulse oscillation is stopped. Even if a power source is applied again, the starter will never operate.

Furthermore, in the starter of FIG. 7, to conduct a stable control of the oscillation phase of the starter pulse voltage, a control resistor 32 is connected in parallel to the semiconductor switching element 25. When the NCC element 24 is used, due to the so-called depolarization at the time of transition from the ferroelectric property to he paraelectric property for every lighting of the arc tube 23, pyroelectricity flows in the NCC element 24. To prevent the non-linear characteristics of the NCC element 24 from deteriorating during the lamp life because of this pyroelectricity, a bypassing resistor for allowing the pyroelectricity to flow in a different way needs to be connected in parallel to the NCC element 24. In the circuit configuration of FIG. 7, the heating resistor 30 and the control resistor 32 function a such a bypass resistor for protection of the NCC element.

When the high pressure sodium lamp integrated with the conventional starter using the NCC element of the above-mentioned configuration is used actually in various applications, a new problem arose that the original starting function is deteriorated, and that in some cases, the lamp arc tube does not start surely, because of adding the above-mentioned safety functions.

In the conventional high pressure sodium lamp, as described above, in order to raise the temperature of the NCC element quickly to the Curie temperature to stop the oscillation of the starting pulse voltage when the lamp fails to light, a heating resistor is disposed adjacent to the NCC element. Even if the temperature of the NCC element is in a range lower than the Curie temperature, as the temperature thereof rises, the current switching operation becomes dull, and the starting pulse voltage to be induced is reduced. For example, at temperatures approximating the Curie temperature, the starting pulse voltage is reduced to ½ or less of the value at a normal temperature. On the other hand, when starting a high pressure discharge lamp, there inevitably is a so-called discharge starting lag time from the application of a power source to the starting of the lamp. In particular, in practical use, when the wiring distance from the ballast to the lamp installation position becomes long, and thus the damping of the starting pulse voltage becomes larger, the discharge starting lag time mentioned above becomes longer. In such a case where the discharge lag time is long, due to the quick temperature raise of the NCC element according to the effect of the heating resistor, the reduction of the starting pulse voltage becomes too large, so that the lamp arc tube cannot be started in some cases. This is the first problem.

As a second problem, it also became clear that when the lamp is at the end of its life, an arc discharge still arises in the outer tube glass bulb even though it is suppressed. This is due to the fact that according to the conventional technique, it takes a comparatively long time from the destruction and the conduction by the creeping discharge of the NCC element to the fusing of the filament coil for fuse 31, and that a variance range among the lamps also is comparatively large. For example, three are cases where it takes ten and several minutes at most until the fusing takes place. If it takes such a long time, there are cases where an arc discharge arises before the filament coil for fuse 31 is fused.

In addition to the two problems mentioned above, the following problems still remain unsolved. The problems are caused by the fact that the NCC element and the semiconductor switching element are mounted within the lamp which is to have a high temperature though they should avoid being operated at or exposed to a high temperature.

The first problem relates to restarting of the lamp after a steady lighting state. At the time of restarting, in order to induce a sufficient starting pulse voltage for starting the lamp, the NCC element needs to be operated at a relatively low temperature range of not more than about 65° C. However, for example, when a lamp of a high watt 360W type is lit up and turned off inside an apparatus, the temperature of the NCC element is increased to 240° C. or higher, and it takes a relatively long time to lower this temperature to the above temperature that is applicable to restarting of the lamp. Therefore, although the upper limit of he time for restarting a high pressure sodium lamp is set normally as 15 minutes, the actual restarting time of a high pressure sodium lamp needs to be set longer than that in some cases.

Another problem is the problem of characteristic deterioration of the semiconductor switching element 25 due to its exposure to a high temperature in a steady lighting state. Normally, the guaranteed heat-resistant temperature of the semiconductor switching element 25 at the time of storage (exposure) is defined as about 130° C. However, even if the semiconductor switching element 25 is positioned inside the base to reduce its temperature as described above, in practical use, for example, when a high wattage lamp of the 360W type is lit inside an apparatus, the exposure temperature of the semiconductor switching element 25 substantially exceeds the specified value mentioned above.

Furthermore, since in this case the semiconductor switching element 25 is positioned inside the base by using the glass stem (See FIG. 8) as described above, and a distance between the lead wire connected to the semiconductor switching element 25 and the lead wire connected to another power source or ballast is short, both wires may contact each other or a discharge may be generated between both wires. To prevent this from occurring, a measure of coating the lead wires with an insulating tube is taken, but because of this, the manufacturing cost is increased.

As described above, in the starter using the NCC element according to the conventional technique, both the lamp starting function and the safety function still cannot be applied sufficiently to practical use. Furthermore, other various problems still remain to be solved, so that a further improvement of both functions and a solution to the various problems are desired by the market.

SUMMARY OF THE INVENTION

It is an object of the present invention to provide a high pressure discharge lamp integrated with a starter using a NCC element, having higher quality and safety, which is achieved by improving the lamp starting function an the safety function of the starter to a level that is sufficiently applicable to practical use.

A high pressure discharge lamp of the present invention comprises an arc tube; a starter including a ferroelectric ceramic capacitor element with non-linear characteristics and a semiconductor switching element in which the capacitor element and the switching element are connected in parallel to the arc tube; an outer tube glass bulb containing the arc tube and the starter; a glass stem for sealing the outer tube glass bulb; and a base positioned at an end portion of the outer tube glass bulb on the glass stem side. In the basic configuration of the present invention, a pulse stopping thermally-actuated switch is connected in series to the ferroelectric ceramic capacitor element and is operated to OFF due to heating by a heating resistor in a non-lighted state of the lamp.

According to this configuration, even when a discharge starting lag time is long, a temperature rise of the ferroelectric ceramic capacitor element is small, and a starting pulse voltage is maintained almost without any reduction. Therefore, a sure starting of the lamp can be obtained, and without accompanying a reduction of the starting function, the safety function against a non-lighted state of the lamp can be provided.

It is preferable that the high pressure discharge lamp has a starting circuit opening thermally-actuated switch for maintaining the starter in an OFF operation state at the time when the arc tube is lit, and that a recovery time of the pulse stopping thermally-actuated switch at the time of restarting the lamp is shorter than a recovery time of the starter circuit opening thermally-actuated switch. Thereby, a restarting of the lamp can be performed more surely.

Furthermore, it is preferable that the heating resistor is connected in parallel to the pulse stopping thermally-actuated switch and the ferroelectric ceramic capacitor element, and that a bypass resistor is connected in parallel to the pulse stopping thermally-actuated switch. Thereby, in the case where the pulse stopping thermally-actuated switch is off, the paraelectricity accompanied by the depolarization of the ferroelectric ceramic capacitor flows to the ferroelectric ceramic capacitor element via the heating resistor and the bypass resistor. Since the heating resistor also has the function of the bypass resistor of discharging the charge remaining in the ferroelectric ceramic capacitor, the starting circuit can be simplified.

Furthermore, it is preferable that the outer tube glass bulb is evacuated, and that in the outer tube glass bulb, a leaking filament coil connected in series to the ferroelectric ceramic capacitor and an electrode positioned adjacent to the leaking filament coil are provided so as to conduct an arc discharge between the coil and the electrode. Thereby, when a start assisting gas etc. leaks into the outer tube glass bulb at the end of the lamp life, the oscillation of the starting pulse voltage can be stopped more quickly, compared to the conventional lamp, and the generation of an arc discharge between lead wires in the outer tube glass bulb can be prevented more surely.

In the above-mentioned high pressure discharge lamp, it is preferable that a ceramic substrate is positioned between the arc tube and the glass stem in such a manner that the ceramic substrate is substantially perpendicular to a tube axis of the arc tube, and that on the glass stem side of the ceramic substrate, the ferroelectric ceramic capacitor element, the pulse stopping thermally-actuated switch and the heating resistor therefor, and a semiconductor switching element are positioned, and that on the arc tube side of the ceramic substrate, the starting circuit opening thermally-actuated switch is positioned.

Thereby, with regard to the problem in practical use of a high pressure discharge lamp equipped with a starter, the restarting of the lamp can be guaranteed and the restarting time can be reduced, and a rise of the exposure temperature of a semiconductor switching element in a steady lighting state of the lamp can be prevented.

In this high pressure discharge lamp, it is preferable that the pulse stopping thermally-actuated switch is positioned on the surface of the ceramic substrate on the glass stem side, and that a thickness of the ceramic substrate is set to be not more than 2.0 mm. Thereby, the recovery time of the pulse stopping thermally-actuated switch at the time of restarting the lamp is set easily to be shorter than the recovery time of the starting circuit opening thermally-actuated switch, sot hat a sure and normal lamp restarting can be performed.

In the above-mentioned high pressure discharge lamp, it is preferable that the pulse stopping thermally-actuated switch is positioned in parallel to the heating resistor, and that a resistance of the heating resistor is set in a range of 20 kΩ to 40 kΩ, a power of the heating resistor is set in a range of 0.25W to 0.5W, and a distance between the pulse stopping thermally-actuated switch and the heating resistor is set to be not more than 2.0 mm. Thereby, even when the lamp fails to light in the condition of a low ambient temperature, the pulse stopping thermally-actuated switch is operated to OFF surely, and the oscillation of the starting pulse voltage can be stopped.

In this high pressure discharge lamp, it is preferable that a tip portion of the pulse stopping thermally-actuated switch is positioned in contact with the heating resistor. Thereby, even when the lamp fails to light in the condition of a low ambient temperature, the pulse stopping thermally-actuated switch is operated to OFF even more surely, and the oscillation of the starting pulse voltage can be stopped.

In the above-mentioned high pressure discharge lamp, it is preferable that the ferroelectric ceramic capacitor is placed substantially in parallel to the surface of the ceramic substrate on the glass stem side, and that a distance with the ceramic substrate is set to be not less than 0.5 mm. Thereby, the ferroelectric ceramic capacitor element can be prevented from breaking by the application of the starting pulse voltage.

In the above-mentioned high pressure discharge lamp, it is preferable that the semiconductor switching element is positioned outside the outer tube glass bulb and inside the base. Thereby, the exposure temperature in a steady lighting state of the semiconductor switching element positioned inside the base is reduced even more, compared to the one according to the conventional technique. As a result, also in a high watt type lamp, the exposure temperature can be suppressed substantially to the normal guaranteed heat-resistant temperature of not more than 130° C., and the characteristic deterioration of the semiconductor switching element during the life of the lamp can be prevented.

In this high pressure discharge lamp, it is preferable that in the glass stem, one lead wire connected to one end of the semiconductor switching element and two lead wires connected to a power source are sealed, and that a sealing portion of the three lead wires in the glass stem has a cross section of a triangular shape, and that the three lead wires are sealed respectively in corners of the triangular shape. Thereby, the three lead wires are sealed with a comparatively long distance to each other, compared to the one according to the conventional technique, so that a contact of the lead wires or a discharge between the lead wires in the base can be prevented without covering an insulating tube.

DETAILED DESCRIPTION OF THE INVENTION

In the following, embodiments of the present invention will be explained by referring to FIG. 1 to FIG. 6.

First Embodiment

FIG. 1 to FIG. 4 show the configuration of a built-in starter type high pressure sodium lamp 15 in the first embodiment of the present invention.

Figure 1:
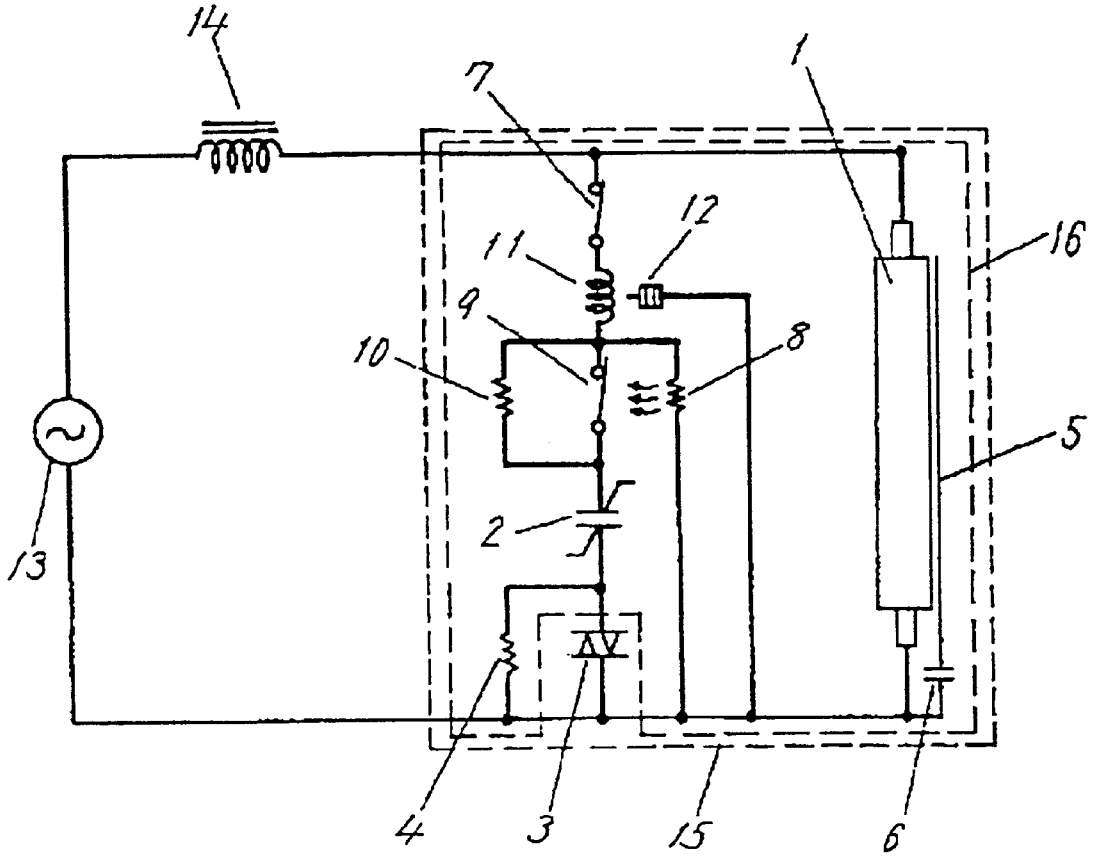
FIG. 1 is a circuit diagram showing a starter of a high pressure sodium lamp according to a first embodiment of the present invention.

FIG. 1 shows the basic circuit configuration of a starter incorporated into the high pressure sodium lamp of the present embodiment. An arc tube 1 included in the high pressure sodium lamp 15 has a container made of an alumina ceramic tube, and inside the tube, sodium amalgam and xenon of 20 kPa to 30 kPa as a rare gas are filled for assisting a start.

The starter equipped in the high pressure sodium lamp 15 includes a series circuit including a starting circuit opening thermally-actuated switch 7, a leaking filament coil 11, a pulse stopping thermally-actuated switch 9, a ferroelectric ceramic capacitor (hereinafter referred to as a NCC element) 2 and a bilateral semiconductor switching element 3 (hereinafter referred to as a semiconductor switching element). The arc tube 1 is connected in parallel to this series circuit. At both ends of the pulse stopping thermally-actuated switch 9, both ends of a bypass resistor 10 are connected. A control resistor 4 is connected in parallel to the semiconductor switching element 3. A heating resistor 8 is positioned in the vicinity of the pulse stopping thermally-actuated switch 9 and is connected in parallel to the pulse stopping thermally-actuated switch 9, the NCC element 2, and the semiconductor switching element 3. Furthermore, a tungsten electrode 12 is provided in the vicinity of the leaking filament coil 11. An end portion of the tungsten electrode 12 is connected to a junction of one end of the arc tube 1 and the semiconductor switching element 3.

A starting operation of this starting circuit is as follows. When a source voltage 13 (200V/220V) is applied, due to a current switching operation of the NCC element 2, a starting pulse voltage of 1500V to 2000V is induced stably for every half cycle in a reactance ballast 14 so as to be superposed on the source voltage, and thus, the arc tube 1 is started. As the NCC element 2, a disc-shaped element made of a zirconate titanate barium ceramic type ferroelectric substance is used, and also to conduct a stable control of an oscillation phase of the starting pulse voltage, the control resistor 4 is connected in parallel to the semiconductor switching element 3. In this operation, the semiconductor switching element 3 serves to raise the starting pulse voltage even more as described above. Furthermore, in order to obtain a stable starting of the arc tube with the above starting pulse voltage value, a start assisting conductor 5 made of a molybdenum wire is attached to the outer surface of the arc tube 1. One end of the start assisting conductor 5 is connected to one end of the arc tube 1 via a capacitor 6. The capacitor 6 serves to prevent sodium from disappearing from the inside of the arc tube 1 by maintaining the start assisting conductor 5 in an insulating state close to a so-called floating potential against the arc tube 1 in the steady lighting state of the lamp.

After the arc tube is started, the so-called lamp voltage applied to the arc tube 1 is as low as about 30V, so that the voltage applied to the NCC element 2 also is reduced, and a current switching operation becomes impossible in the NCC element 2, and the oscillation of the starting pulse voltage is stopped. Next, due to the heating of the arc tube 1 after starting, the starting circuit opening thermally-actuated switch 7 made of a bimetal element is operated to OFF, and the steady lighting state of the arc tube 1 is maintained in a state in which the starting circuit part is cut off from the lighting circuit of the arc tube. In addition, in the stable lighted state, a temperature of the NCC element 2 is raised to the Curie temperature or higher due to the heating of the arc tube 1, and thus, the NCC element 2 maintains the state of paraelectricity.

Figure 7:
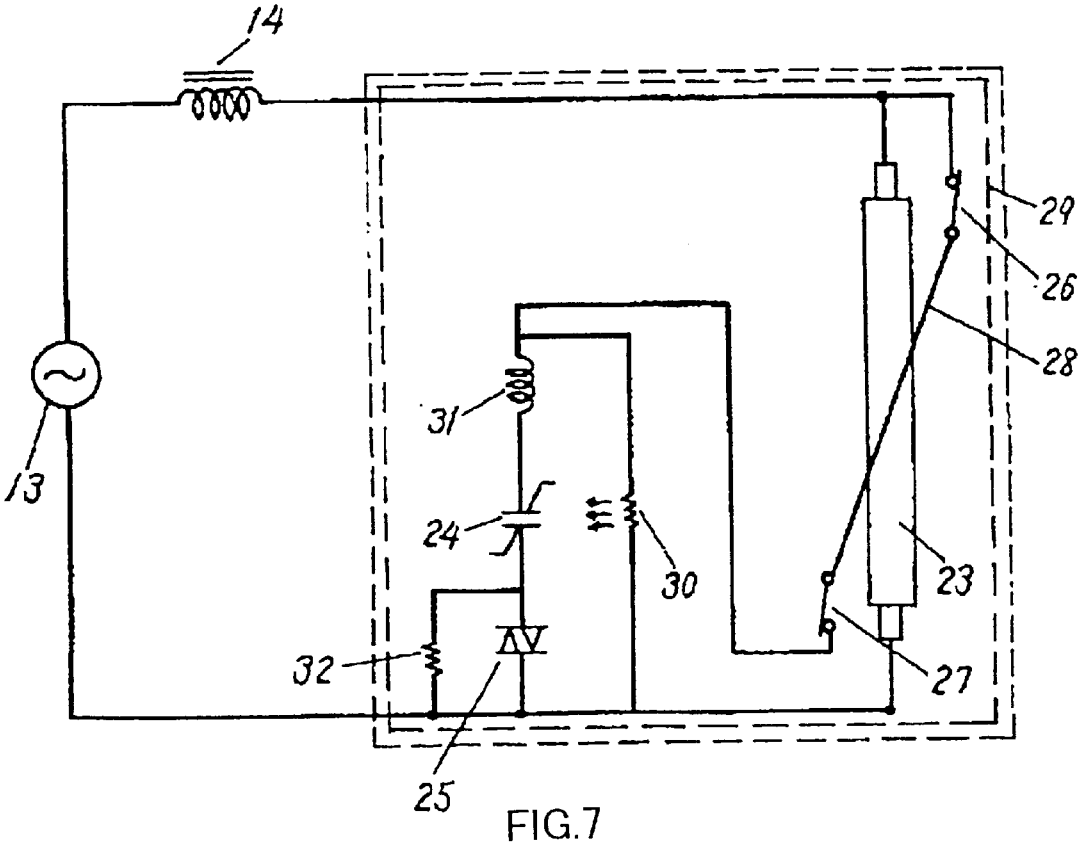
FIG. 7 is a circuit diagram showing a starter of a conventional high pressure sodium lamp.

The circuit configuration shown in FIG. 1 has two advantageous features compared to the conventional technique. The first feature is that a sufficient starting function can be maintained even if the circuit has the safety function of stopping the oscillation of the starting pulse voltage in correspondence to the non-lighted state of the lamp. In the conventional technique shown in FIG. 7, at the time the lamp fails to light, the current switching operation is stopped by the temperature rise of NCC element 24 due to the heating by the heating resistor 30. In this case, when the discharge starting lag time becomes long, due to the reduction of the starting pulse voltage, a new problem arose in practical use in that the arc tube 23 could not be started. On the other hand, in the circuit configurations shown in FIG. 1, the pulse stopping thermally-actuated switch 9 made of a bimetal element is connected in series to the NCC element 2. The switch 9 is operated to OFF due to the heating by the heating resistor 8 in the non-lighted state of the lamp. Thereby, the voltage applied to the NCC element 2 is reduced, and the current switching operation, that is, the oscillation of the starting pulse voltage is stopped. Therefore, even when the starting lag time for starting the lamp is long in practical use, the starting pulse voltage is maintained almost without any reduction until the pulse stopping thermally-actuated switch 9 is operated to OFF, so that the arc tube 1 of the lamp can be started more surely. As a result, the starter according to the present invention was not only equipped with the safety function responsive to the non-lighted state of the lamp, but also could maintain a more certain starting function in practical use compared to the conventional technique.

In the circuit configuration shown in FIG. 1, the heating resistor 8 is connected in parallel to the NCC element 2 and the pulse stopping thermally-actuated switch 9, and together with the bypass resistor 10 connected in parallel to the pulse stopping thermally-actuated switch 9, the heating resistor 8 also has the function as that of the bypass resistor 10 to discharge the charge remaining in the NCC element 2 when the pulse stopping thermally-actuated switch 9 is operated to OFF. In addition, when the lamp is started normally and is in a stable lighted state, the pulse stopping thermally-actuated switch 9 is maintained in the state of OFF operation due to the heating of the arc tube 1.

With regard to the operation of the pulse stopping thermally-actuated switch 9 in restarting the lamp, one condition needs to be fulfilled. That is, when the lamp is restarted, the pulse stopping thermally-actuated switch 9 needs to recover faster than the starting circuit opening thermally-actuated switch 7 and switch ON the operation. If the starting circuit opening thermally-actuated switch 7 recovers faster and switches ON the operation, an electric current flows in the heating resistor 8, and due to the heating thereby, the OFF operation state of the pulse stopping thermally-actuated switch 9 is maintained as it is. Thus, the NCC element 2 is inoperative, and it becomes impossible to restart the lamp.

Furthermore, in the steady lighting state of the lamp, in order to prevent the characteristics of the NCC element 2 from deteriorating because of the pyroelectricity mentioned above, it is necessary to connect the bypass resistor 10 for protection of the NCC element in parallel to the pulse stopping thermally-actuated switch 9. In the case of the circuit shown in FIG. 1, besides the bypass resistor 10, the heating resistor 8 and the control resistor 4 also have the function of discharging the charge remaining in the NCC element 2, so that the starting circuit is simplified by this.

The second feature relates to the safety function for preventing an arc discharge in the outer tube, caused by a xenon leakage from the inside of the arc tube at the end of life of the lamp. In the conventional technique shown in FIG. 7, the arc discharge was suppressed by the fusing of the filament coil for fuse 31 caused by the destruction/conduction of the NCC element 24. However, it took a relatively long time until the fusing took place, and it was difficult to sufficiently prevent the arc discharge from occurring. On the other hand, in the circuit shown in FIG. 1, the leaking filament coil 11 is connected in series to the NCC element 2, and the tungsten coil electrode 12 with an emissive material faces the leaking filament coil 11. According to this operation, at the time of a xenon leakage, an arc discharge is generated quickly between the leaking filament coil 11 and the tungsten coil electrode 12 by the starting pulse voltage, so that the leaking filament coil 11 is fused. The time required for fusing the leaking filament coil 11 could be reduced to at most not more than 20 seconds, compared to the longest time of ten and several minutes in the conventional technique. Furthermore, a variance range among the lamps also is reduced, so that the generation of an arc discharge at the time of a xenon leakage etc. could be prevented even more surely.

Figure 2:
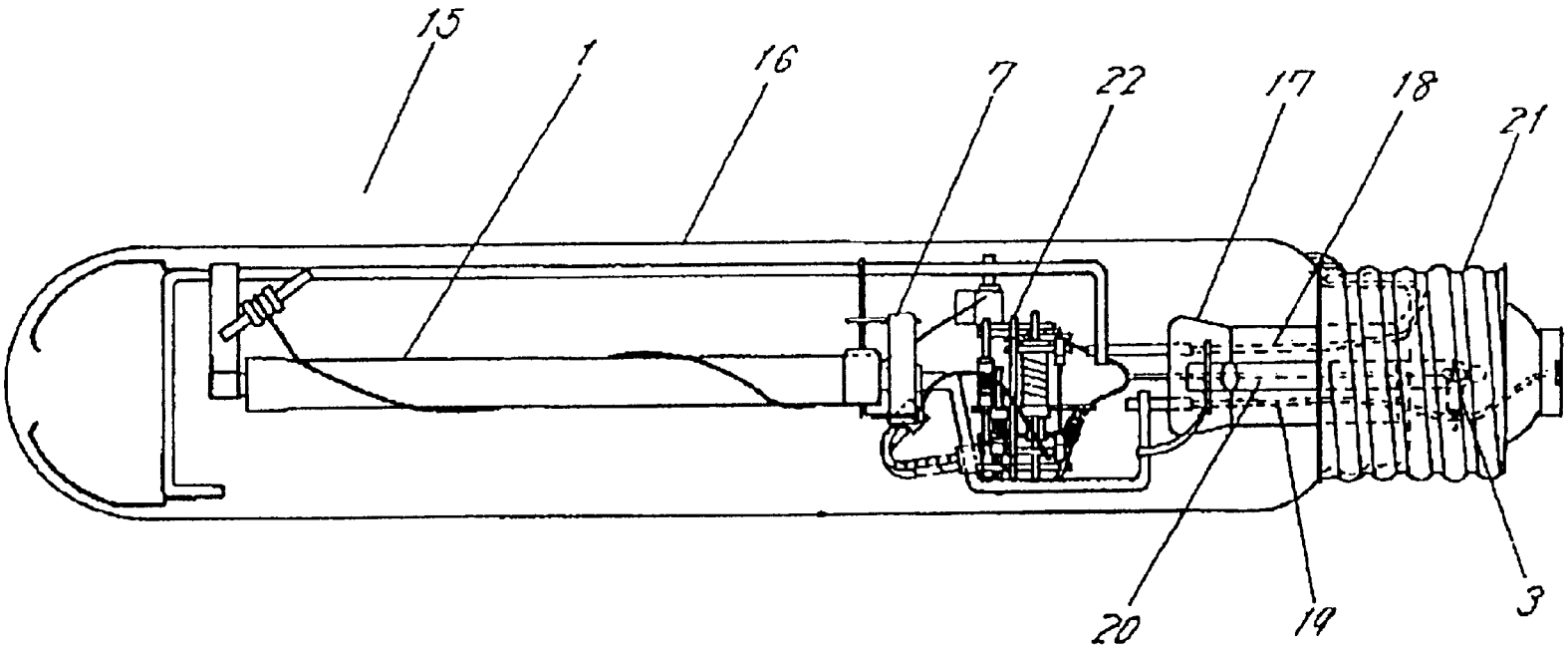
FIG. 2 is a front view showing the overall configuration of the high pressure sodium lamp.

FIG. 2 shows the overall configuration of the high pressure sodium lamp 15 in the present embodiment as a completed product. Inside an evacuated outer tube glass bulb 16, the arc tube 1 and all parts for the starter excluding the semiconductor switching element 3 are assembled and positioned. The outer tube glass bulb 16 is sealed airtight by the glass stem 17. In the glass stem 17, three lead wires, that is, the lead wires 18, 19 connected to both electrode parts of the arc tube 1 and the lead wire 20 connected to one end of the semiconductor switching element 3 are sealed airtight. The semiconductor switching element 3 is positioned inside a base 21 having a lower temperature during operation than the atmospheric temperature to prevent deterioration of the characteristics.

Figure 3:
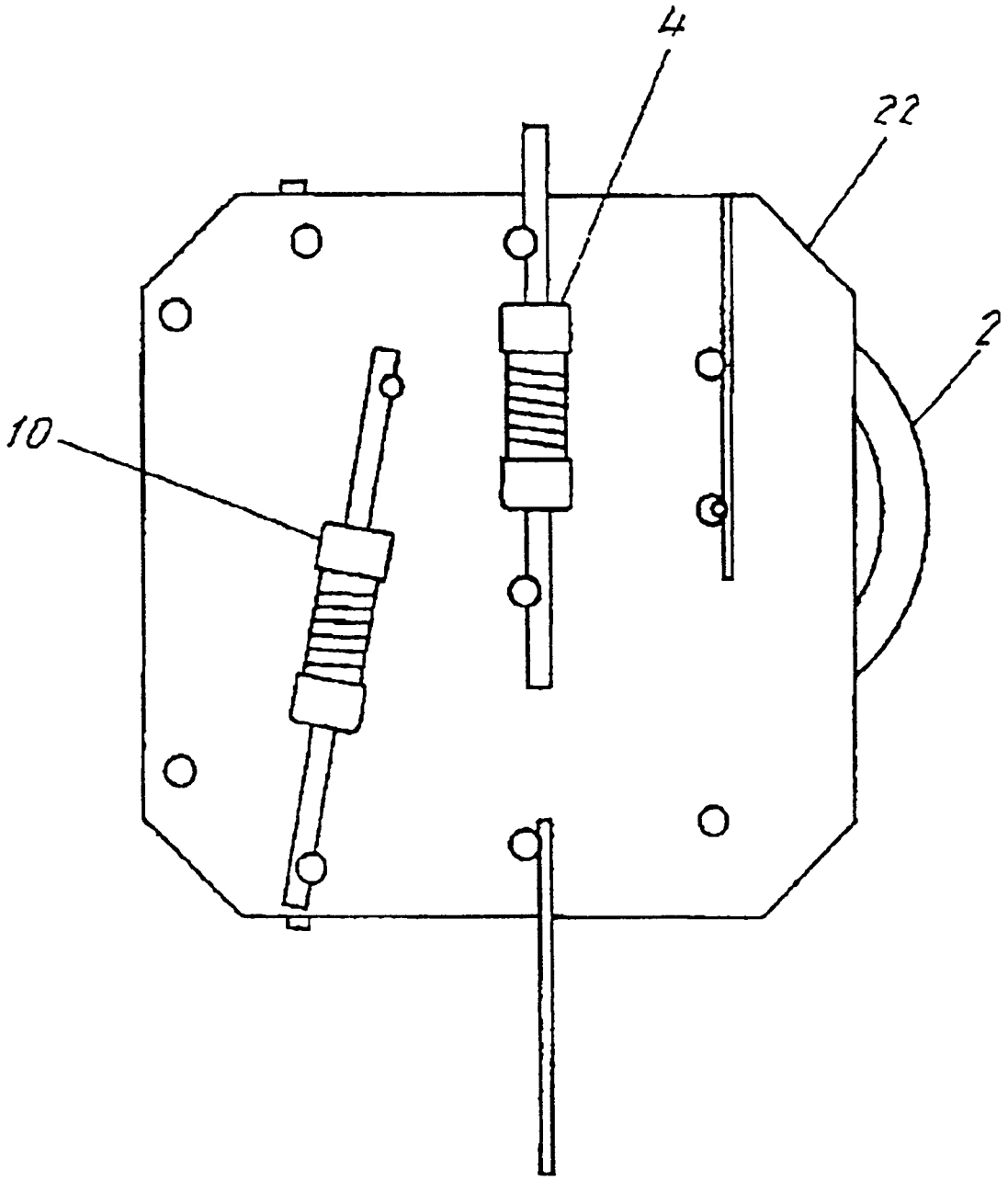
FIG. 3 is a view showing an assembling configuration of parts for the starter in the high pressure sodium lamp.
Figure 4:
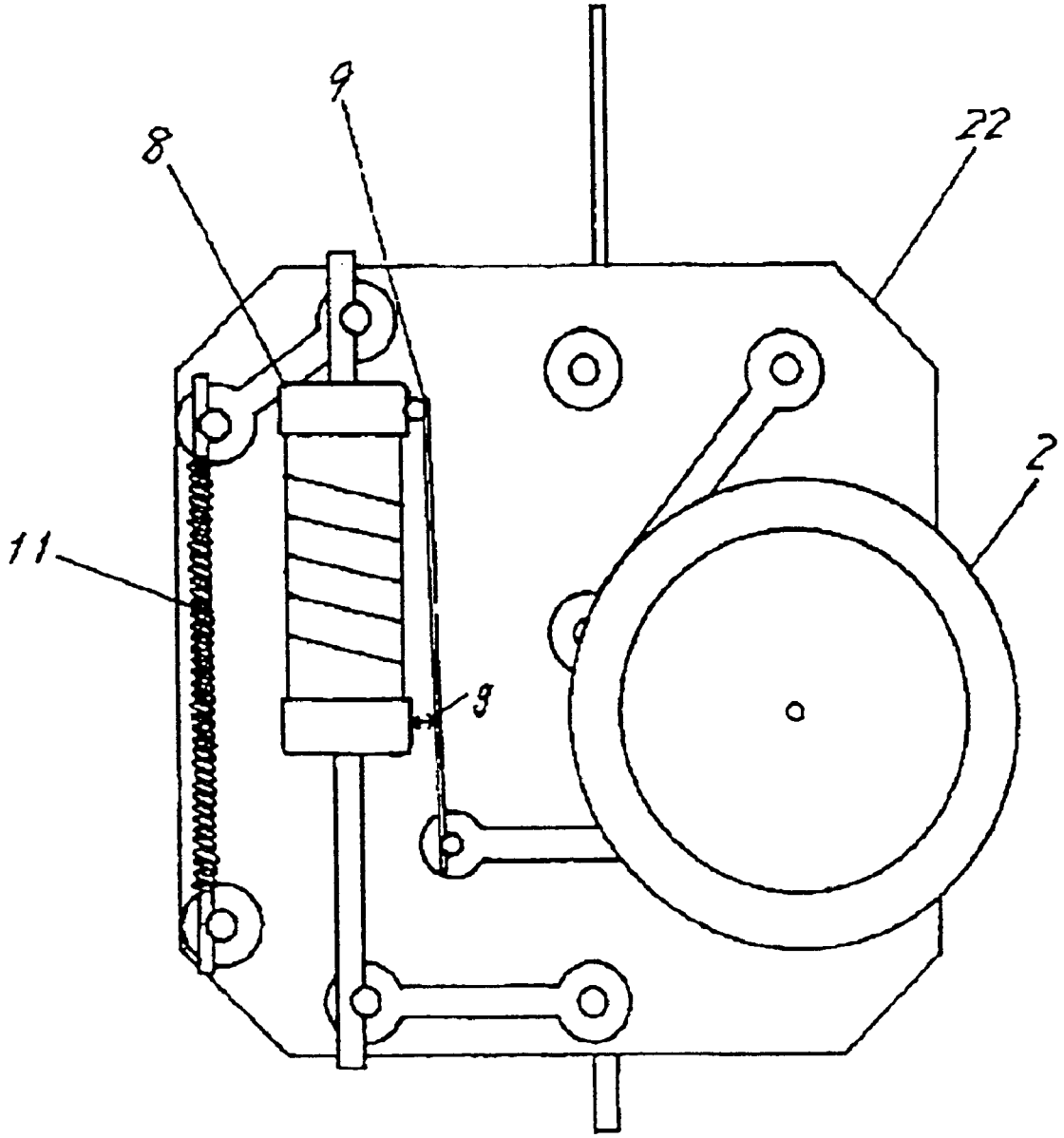
FIG. 4 is a view of the parts seen from the back of the plane shown in FIG. 3.

FIGS. 3 and 4 show the assembling configuration of the starter parts according to the embodiment. FIG. 4 is a back view of the figure shown in FIG. 3.

The basic feature of the parts assembling configuration in FIG. 3 and FIG. 4 is that a ceramic substrate 22 made of alumina etc. is positioned in the middle of the arc tube 1 and the glass stem 17. Besides being used for assembling the parts for the starter, the ceramic substrate 22 is arranged substantially perpendicularly to a tube axis of the arc tube 1, so that the ceramic substrate 22 has the important function of shielding specific parts from the heating by the arc tube 1 in the steady lighting state of the lamp. On the glass stem 17 side of the ceramic substrate 22 where it is shielded substantially from the arc tube 1, among the parts of the starter, the NCC element 2, the pulse stopping thermally-actuated switch 2 and the heating resistor 8 therefore, and the semiconductor switching element 3 are disposed. On the arc tube 1 side of the ceramic substrate 22, the starting circuit opening thermally-actuated switch 7 is disposed.

According to this configuration, as a concrete measure to solve the above-mentioned operational problem of the pulse stopping thermally-actuated switch 9 at the time of restarting the lamp or the above-mentioned various problems in practical use, sufficient effects could be obtained as will be described below.

First, as described above, the recovery time of the pulse stopping thermally-actuated switch 9 according to the present invention at the time of restarting the lamp needs to be set shorter than that for the starting circuit opening thermally-actuated switch 7 so that the pulse stopping thermally-actuated switch 9 is operated to ON more quickly at the time of restarting the lamp. As a concrete measure to achieve this, the pulse stopping thermally-actuated switch 9 is disposed on the surface of the ceramic substrate 22 on the glass stem side, while the starting circuit opening thermally-actuated switch 7 is disposed adjacent to the end portion of the arc tube on the arc tube side of the ceramic substrate 22. Furthermore, as a prerequisite for the case of arranging the pulse stopping thermally-actuated witch 9 substantially in parallel to the surface of the ceramic substrate 22, as shown in FIG. 4, in order to reduce the heat capacity of the ceramic substrate 22, a thickness of this substrate was set to be not more than 2.0 mm. Accordingly, the temperature of the pulse stopping thermally-actuated switch 9 in the steady lighting state of the lamp was maintained lower than the starting circuit opening thermally-actuated switch 7. Therefore, at the time of restarting the lamp, the pulse stopping thermally-actuated switch 9 was operated to ON more quickly and easily than the starting circuit opening thermally-actuated switch 7, so that a sure and normal restarting of the lamp could be obtained. In the arrangements of FIG. 3 and FIG. 4, when the ceramic substrate 22 with a substrate thickness of not less than 2.0 mm was used, the recover time of the pulse stopping thermally-actuated switch 9 at the time of restarting the lamp became longer than that for the starting circuit opening thermally-actuated switch 7 due to a comparatively large amount of heat stored in the ceramic substrate 22 during the steady lighting state of the lamp, so that there were cases where a normal lamp restarting could not be obtained.

Next, in the process of developing the assembling configurations in FIG. 3 and FIG. 4, it became clear that particularly in the case where the lamp fails to light when the lamp is started in the condition of a low ambient temperature, there is a possibility that the pulse stopping thermally-actuated switch 9 is not operated to OFF and thus inoperative due to the difficulty of raising the temperature. Thus, as another prerequisite related to the arrangement of the switch 9 in the configuration of FIG. 4, a resistance value and a power of the heating resistor 8 and the layout distance with the switch 9 are set in a specific range in order to guarantee a sure OFF operation of the switch 9 also in the non-lighted state of the lamp when the lamp is started at a low temperature. In other words, if the resistance value of the heating resistor 8 is too low, the starting pulse voltage to be induced is reduced, so that a normal lamp cannot be started. On the other hand, if the resistance value is too high, the amount of heating is reduced, so that the switch 9 cannot be operated to OFF in the non-lighted state of the lamp. Therefore, the resistance value of the heating resistor 8 is set in a range of 20 kΩ to 40 kΩ, and the power is set in a range of 0.25W to 0.5W, and a distance g with the switch 9 disposed in parallel to the heating resistor 8 is set to be not more than 2.0 mm. Thereby, even when the lamp failed to light at a low temperature, the switch 9 was operated to OFF surely, and the oscillation of the starting pulse voltage could be stopped. In this case, furthermore, as shown in FIG. 4, by positioning the tip portion of the bimetal element of the switch 9 in direct contact with an end cap of the heating resistor 8, the switch 9 could be operated to OFF even more surely.

Next, according to the assembling configuration of the parts for the starter in the lamp of the conventional technique, there were cases where the temperature of the NCC element 24 rose in the steady lighting state of the lamp, so that the restarting time of, for example, a high watt type lamp needed to be set above the normal upper limit of 15 minutes. On the other hand, in the present embodiment, the NCC element 2 is positioned on the surface of the ceramic substrate 22 on the glass stem side. Accordingly, the temperature rise of the NCC element 2 in the steady lighting state of the lamp is reduced, and when the lamp is to be restarted, the temperature of the NCC element 2 declines relatively quickly to 65° C. or lower where a sufficient starting pulse voltage can be induced. Therefore, even in the case of a high watt 360W type lamp, the restarting time could be set easily to not more than the normal upper limit of 15 minutes.

Next, as shown in FIG. 4, in the configuration in which the NCC element 2 is arranged substantially in parallel to the surface of the ceramic substrate 22, it was confirmed that when the layout distance between the NCC element 2 and the ceramic substrate 22 becomes too short, the NCC element 2 is broken by the application of a starting pulse voltage of about 2000V. This is due to the fact that an internal field strength distribution of the NCC element 2 becomes inhomogeneous, and that a local intense electric field is generated. Therefore, in order to prevent such a breakdown of the NCC element, the layout distance was set to be not less than 0.5 mm. Thereby, a breakdown of the NCC element 2 could be prevented surely.

Furthermore, according to the assembling configuration of the parts for the starter in the lamp of the conventional technique, even when the switching element 25 was positioned inside the lamp base having a lower temperature, the exposure temperature in the steady lighting state of a high watt type lamp substantially exceeded the guaranteed heat-resistant temperature of 130° C. On the other hand, in the present embodiment, the semiconductor switching element 3 is positioned on the glass stem side with respect to the ceramic substrate 22 and also inside the base 21. Accordingly, the portion of this base 21 itself is shielded effectively from the heating by the arc tube 1 by the ceramic substrate 22. Therefore, even in the case of a high watt type lamp, the exposure temperature of the semiconductor switching element 3 was suppressed to not more than 130° C., and the characteristic deterioration during the life of the lamp could be prevented.

Figure 5A:
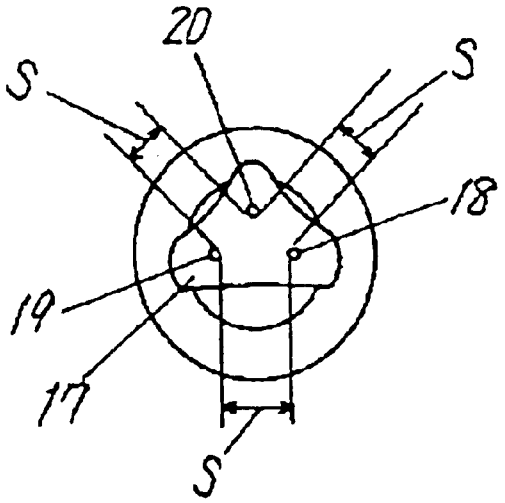
FIG. 5A is a plan view showing a glass stem of the high pressure sodium lamp.
Figure 5B:
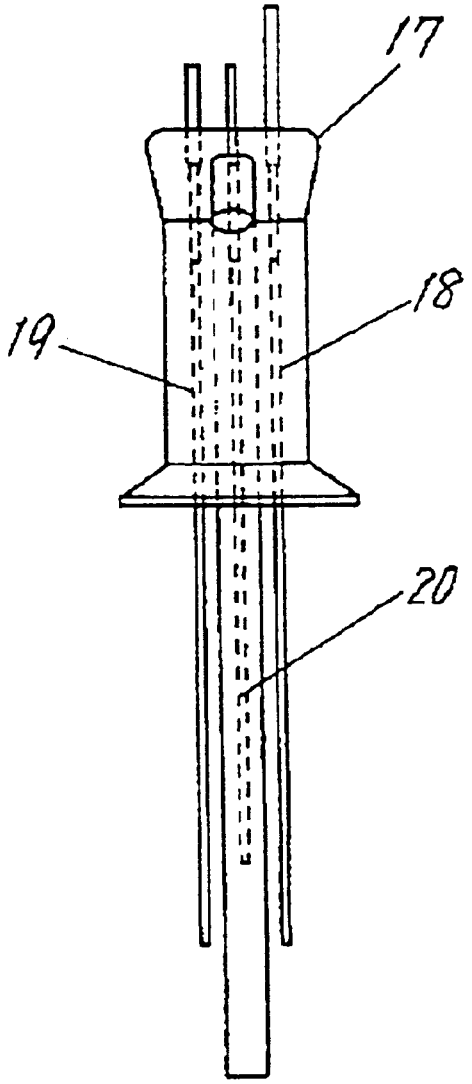
FIG. 5B is a front view showing the glass stem.

FIG. 5A and FIG. 5B show the structure of the glass stem 17 in which the three lead wires 18, 19 and 20 are sealed in an airtight condition in the high pressure sodium lamp 15 according to the first embodiment of the present invention.

Figure 8A:
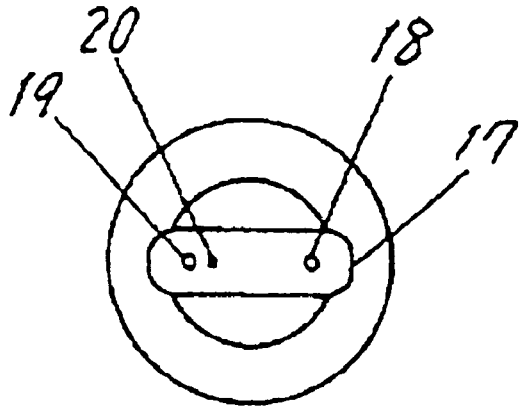
FIG. 8A is a plan view showing the structure of a glass stem in a conventional built-in starter type high pressure sodium lamp.
Figure 8B:
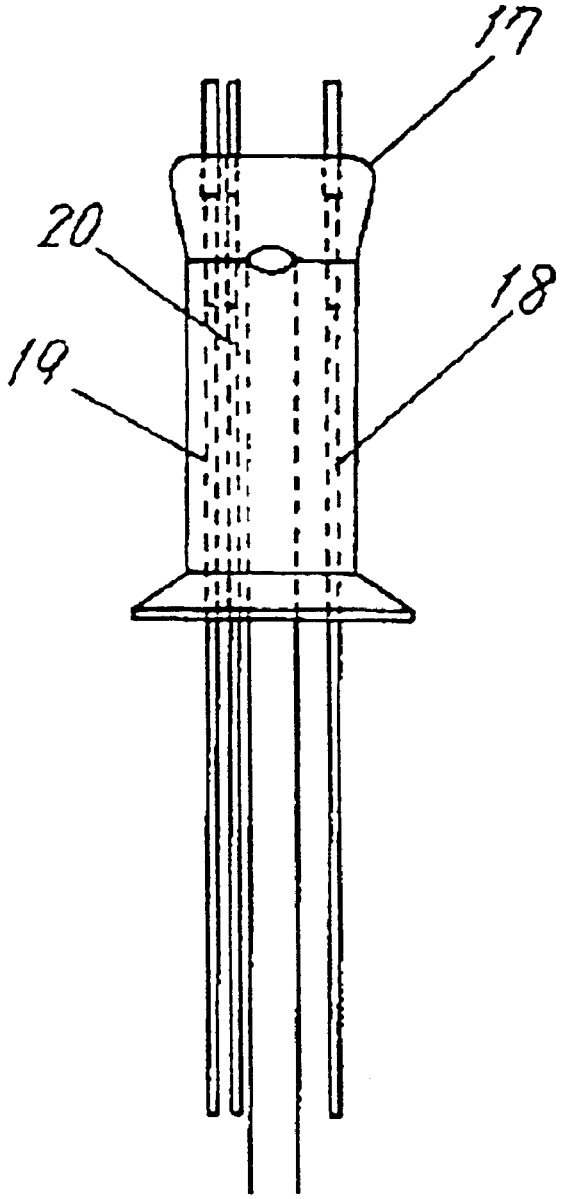
FIG. 8B is a front view showing the structure of the glass stem.

In the glass stem structure of FIG. 8 according to the conventional technique, a distance between the lead wire 19 connected to the semiconductor switching element 25 and the other lead wire 20 was too short, so that there were cases where both wires contacted to each other or a discharge arose between both wires. In order to prevent this from occurring, usually the lead wires are covered with an insulating tube. On the other hand, in the present embodiment, the cross-sectional shape of the sealing portion of the three lead wires 18, 19, 20 differs from the conventional long and narrow rectangular shape, as shown in FIG. 5. The sealing portion is molded and processed to form a triangular shape. Accordingly, the lead wire 20 connected to the semiconductor switching element 3 and the lead wires 18, 19 connected to the power source respectively are sealed in the corners of the triangular shape with a comparatively long distance s between each other. Therefore, without using an insulating tube, a contact or a discharge between the lead wire 20 and the lead wires 18, 19 can be prevented surely.

A typical example for the configuration of the high pressure sodium lamp according to the first embodiment is common to a low watt 110W type to a high watt 360W type. First, as for the circuit parts in FIG. 1, the heating resistor 8 is set to be 30 kΩ, the control resistor 4 is set to be 47 kΩ, and the bypass resistor 10 is set to be 47 kΩ. Furthermore, as the leaking filament coil 11, the same coil as that for a usual incandescent lamp of 100V, 80W was used, and as the tungsten coil electrode 12, the same electrode as that for a high pressure mercury lamp 200W was used respectively. Furthermore, for the parts assembling configuration of FIG. 2, the ceramic substrate 22 made of alumina having dimensions of 30 mm×30 mm and a thickness of 1.0 mm was used. The distance g between the heating resistor 8 and the pulse stopping thermally-actuated switch 9 was set to be 1.0 mm, and the tip portion of the bimetal element of the thermally-actuated switch 9 was contacted to the end cap of the heating resistor 8. A layout distance d between the NCC element 2 and the ceramic substrate 22 was set to be 3.0 mm. Furthermore, in the structure of the glass stem 17 in FIG. 5, a sealing distance s between the lead wire 20 and the lead wires 18, 19 was set to be about 5 mm. None of the lead wires 18, 19, 20 was covered with an insulating tube inside the base 21.

The starting voltage in the starting characteristics of the high pressure sodium lamp with the configuration of the above-mentioned example was 1500V to 2000V. This value was not reduced even when the discharge starting lag time was as long as about 10 seconds, and thus, it was confirmed that the lamp was started surely. Furthermore, the fusing time of the leaking filament coil 11 at the time when xenon leaked toward the outer tube glass bulb 16 was in a variance range of 7.0 to 15.7 seconds, and the average of 10.6 seconds was obtained.

When the lamp was restarted, the pulse stopping thermally-actuated switch 9 was operated to ON more quickly than the starting circuit opening thermally-actuated switch 7, and a normal restarting of the lamp was conducted surely. On the other hand, the restarting time of the lamp could be set to be about 14 minutes even with a high watt 360W type, which is not more than the normal upper limit of 15 minutes. The breakdown of the NCC element occurring in relation with this also could be prevented surely.

When the lamp failed to light at the ambient temperature of −40° C., the pulse stopping thermally-actuated switch 9 could be operated to OFF surely, and the oscillation of the starting pulse voltage was stopped. Furthermore, the exposure temperature of the semiconductor switching element 3 inside the base 21 in the steady lighting state of the lamp was about 127° C., which is not more than the guaranteed heat-resistant temperature of 130° C. even with a high watt 360W type. In the base 21, there was not a single contact or discharge generation occurring between the lead wire 20 and the other lead wires 18, 19.

Second Embodiment

Figure 6:
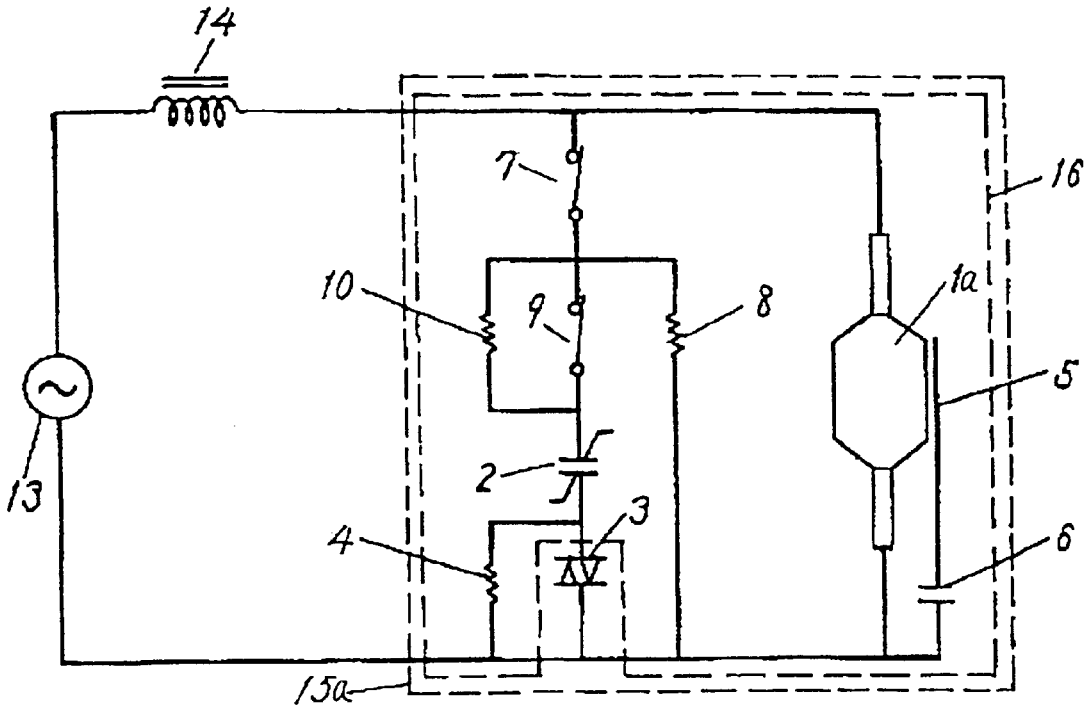
FIG. 6 is a circuit diagram showing a starter of a metal halide lamp according to a second embodiment of the present invention.

FIG. 6 shows the circuit configuration of a starter incorporated into an alumina ceramic metal halide lamp according to a second embodiment of the present invention.

The basic difference between this metal halide lamp 15*a* and the configuration of the high pressure sodium lamp in the first embodiment is that in the metal halide lamp 15*a* of the present embodiment, a gas mainly composed of nitrogen is filled at 300 Torr to 400 Torr inside the outer tube glass bulb 16. As a result, in the metal halide lamp of the present embodiment, even if a rare gas for a starting assistance such as argon leaks from the inside of the arc tube 1*a* to the inside of the outer tube glass bulb 16 at the end of life, the generation of an arc discharge between the lead wires is prevented.

Therefore, different from the configuration of FIG. 1, the configuration of FIG. 6 is not provided with a leaking filament coil and a tungsten coil electrode for prevention of arc discharge at the end of life. The circuit configuration of the starter other than that in FIG. 6 is the same as that in the first embodiment of FIG. 1.

Furthermore, the assembling configuration of the starter in the present embodiment also is the same as that in the first embodiment of FIG. 3 and FIG. 4 except for the filament coil and the bypass resistor mentioned above. Furthermore, as for the structure of the glass stem, the same one as that in FIG. 5 is used.

In this way, the metal halide lamp of the second embodiment can leave out the safety function for the end of life of the lamp, so that improved starting characteristics can be obtained with a simpler configuration.

As described above, by equipping the lamp with the starter having the circuit configuration and the parts assembling configuration shown in each of the above embodiments and the glass stem having an improved structure, both the starting function of the lamp and the safety function are improved to a level that is sufficiently applicable to practical use, compared to the conventional technique, and the above-mentioned various problems in practical use also can be solved. As a result, a built-in starter type high pressure discharge lamp with higher quality and safety can be obtained.

The invention may be embodied in other forms without departing from the spirit or essential characteristics thereof. The embodiments disclosed in this application are to be considered in all respects as illustrative and not limiting. The scope of the invention is indicated by the appended claims rather than by the forgoing description, and all changes which come within the meaning and range of equivalency of the claims are intended to be embraced thereon.

What is claimed is:

1. A high pressure discharge lamp comprising an arc tube; a starter including a ferroelectric ceramic capacitor element with non-linear characteristics and a semiconductor switching element, the capacitor element and the switching element being connected in parallel to the arc tube; an outer tube glass bulb containing the arc tube and the starter; a glass stem for sealing the outer tube glass bulb; and a base positioned at an end portion of the outer tube glass bulb on the glass stem side, wherein a pulse stopping thermally-actuated switch is connected in series to the ferroelectric ceramic capacitor element and is operated to OFF due to heating by a heating resistor in a non-lighted state of the lamp.

2. The high pressure discharge lamp according to claim 1, further comprising a starting circuit opening thermally-actuated switch for maintaining the starter in an OFF operation state at the time when the arc tube is lit, wherein a recovery time of the pulse stopping thermally-actuated switch at the time of restarting the lamp is shorter than a recovery time of the starter circuit opening thermally-actuated switch.

3. The high pressure discharge lamp according to claim 1, wherein the heating resistor is connected in parallel to the pulse stopping thermally-actuated switch and the ferroelectric ceramic capacitor element, and a bypass resistor is connected in parallel to he pulse stopping thermally-actuated switch.

4. The high pressure discharge lamp according to claim 1, wherein the outer tube glass bulb is evacuated, and in the outer tube glass bulb, a leaking filament coil connected in series to the ferroelectric ceramic capacitor and an electrode positioned adjacent to the leaking filament coil are provided so as to conduct an arc discharge between the coil and the electrode.

5. The high pressure discharge lamp according to claim 2, wherein a ceramic substrate is positioned between the arc tube and the glass stem in such a manner that the ceramic substrate is substantially perpendicular to a tube axis of the arc tube, and on the glass stem side of the ceramic substrate, the ferroelectric ceramic capacitor element, the pulse stopping thermally-actuated switch and the heating resistor therefor, and a semiconductor switching element are positioned, and on the arc tube side of the ceramic substrate, the starting circuit opening thermally-actuated switch is positioned.

6. The high pressure discharge lamp according to claim 5, wherein the pulse stopping thermally-actuated switch is positioned on the surface of the ceramic substrate on the glass stem side, and a thickness of the ceramic substrate is set to be not more than 2.0 mm.

7. The high pressure discharge lamp according to claim 1, wherein the pulse stopping thermally-actuated switch is positioned in parallel to the heating resistor, and a resistance of the heating resistor is set in a range of 20 ,Ω to 40 kΩ, a power of the heating resistor is set in a range of 0.25 W to 0.5 W, and a distance between the pulse stopping thermally-actuated switch an the heating resistor is set to be not more than 2.0 mm.

8. The high pressure discharge lamp according to claim 7, wherein a tip portion of the pulse stopping thermally-actuated switch is positioned in contact with the heating resistor.

9. The high pressure discharge lamp according to claim 5, wherein the ferroelectric ceramic capacitor is placed substantially in parallel to the surface of the ceramic substrate on the glass stem side, and a distance with the ceramic substrate is set to be not less than 0.5 mm.

10. The high pressure discharge lamp according to claim 5, wherein the semiconductor switching element is positioned outside the outer tube glass bulb and inside the base.

11. The high pressure discharge lamp according to claim 10, wherein in the glass stem, one lead wire connected to one end of the semiconductor switching element an two lead wires connected to a power source are sealed, and a sealing portion of the three lead wires in the glass stem has a cross section of a triangular shape, and the three lead wires are sealed respectively in corners of the triangular shape.

* * * * *